US005807019A

United States Patent [19]

Meyer

[11] Patent Number: 5,807,019

[45] Date of Patent: Sep. 15, 1998

[54] MAGNETIC GRIPPER DEVICE

[76] Inventor: Ross E. Meyer, 1920 Camino Mora, Las Alamos, N. Mex. 87544

[21] Appl. No.: 858,031

[22] Filed: May 16, 1997

Related U.S. Application Data

[60] Provisional application No. 60/025,962 Sep. 9, 1996.

[51] Int. Cl.[6] ..... B25G 3/00

[52] U.S. Cl. ..... 403/410; 403/DIG. 1; 52/DIG. 4; 36/1; 248/206.5

[58] Field of Search ..... 403/179, 409.1, 403/410, DIG. 1; 52/DIG. 4; 36/1, 132, 136, 116; 248/206.5, 925, 309.4; 182/133, 134, 135, 136; 335/285, 293; 269/8

[56] References Cited

U.S. PATENT DOCUMENTS

| | | | |
|---|---|---|---|
| 3,031,778 | 5/1962 | Nicholson et al. | 52/DIG. 4 X |
| 3,187,347 | 6/1965 | Terron | 403/410 X |
| 3,304,111 | 2/1967 | Kauh | 52/DIG. 4 X |
| 3,895,330 | 7/1975 | Yost | 335/253 |
| 3,925,911 | 12/1975 | Eriebach | 36/2.5 AL |
| 4,320,914 | 3/1982 | Simon | 294/88 |
| 4,651,244 | 3/1987 | Yano | 360/105 |
| 5,192,155 | 3/1993 | Meyer | 403/410 |

FOREIGN PATENT DOCUMENTS

| | | | |
|---|---|---|---|
| 1059294 | 12/1983 | U.S.S.R. | 403/410 |

*Primary Examiner*—Daniel P. Stodola
*Assistant Examiner*—Bruce A. Lev

[57] ABSTRACT

A magnetic gripper provides a support for releasable attachment to a ferromagnetic surface. A magnet adheres the gripper to the ferromagnetic surface. A frame is rotatably attached to the magnet where the frame defines cam surfaces to raise and lower the magnet from the ferromagnetic surface. An ear extends from the magnet to engage the ferromagnetic surface at a location spaced from the cam surfaces so that an end of the magnet near the ear can be first disengaged from the ferromagnetic surface, causing an air gap between the magnet and the ferromagnetic surface. The remainder of the magnet is sequentially disengaged from the surface as the cam surface is rotated. A foot support may be rotatably mounted to the frame so that a user can stand on the gripper to perform maintenance and repairs on the structure defined by the ferromagnetic surface.

6 Claims, 3 Drawing Sheets

MAGNETIC GRIPPER DEVICE

This application claims the benefit of provisional application Ser. No. 60/025,962, filed Sep. 9, 1996.

1. Field of the Invention

This invention generally relates to gripping and holding devices, and, more particularly, to magnetic gripping and holding devices for use with ferromagnetic structures.

2. Background of the Invention

U.S. Pat. No. 5,192,155 is directed to a magnetic gripper device that can be used as a foot hold, hand hold, or the like, to assist a person in climbing a sheer ferromagnetic structure, such as a ship hull, storage tank, steel building frame, bridge, or the like. The gripper device taught therein incorporated cam surfaces into a handle for engaging the ferromagnetic surface and controllably fixing and detaching a magnet to the surface. In order to reduce the force required to fix and detach the magnet, the cam surfaces were unequal, such that one cam surface would lift one side of the magnet before the opposite end of the magnet was affected. Accordingly, strong magnets could be used to support a user on the structure and the user could engage and disengage the magnets to move up, down, and sideways over the surface.

It has been found that in some circumstances the unequal cam surfaces act to turn the gripper away from a vertical orientation. This cocking action can be uncomfortable to the user, particularly if the user is using the gripper as a foot hold for long periods of time. If the cocking angle is too great, a cocked gripper can break free from the climbing surface to the detriment of the user.

The present invention addresses the cocking problem and provides an alternate design for easily fixing and detaching a magnet from a ferromagnetic so that a gripper can be maneuvered over the surface by a user.

Accordingly, it is an object of the present invention to provide a magnetic gripper that remains vertical when fixed to a ferromagnetic surface.

It is another object of the present invention to provide a magnetic gripper that can be easily fixed to and removed from a ferromagnetic surface by a person working on that surface.

Yet another object of the present invention is to provide a stable platform for supporting the foot of a worker so that the worker can readily remove and reattach the gripper assembly to a structure without removing the gripper from the foot.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a magnetic gripper for releasable attachment to a ferromagnetic surface. A magnet adheres the gripper to the ferromagnetic surface. A frame is rotatably attached to the magnet where the frame defines cam surfaces to raise and lower the magnet from the ferromagnetic surface. An ear extends from an end of the magnet to engage the ferromagnetic surface at a location spaced from the cam surfaces to form a lever for disengaging the magnet from the surface as the cam surface is rotated.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
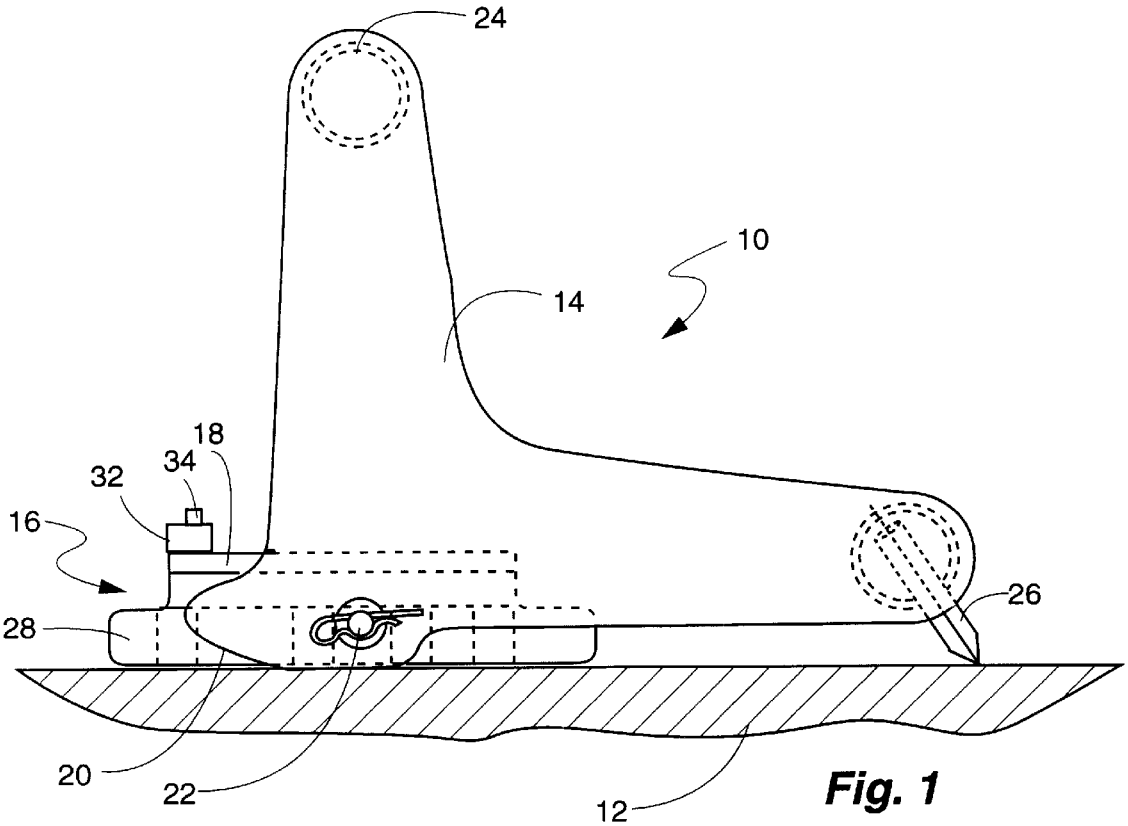
FIG. 1 is a pictorial illustration in side view of one embodiment of the present invention.

Referring first to FIG. 1, there is shown one embodiment of a magnetic gripper for use in climbing along ferromagnetic surfaces, such as storage tanks, steel frames, and the like, where hand holds and fool holds are not available. Gripper assembly 10 includes frame 14 and magnet assembly 16. Magnet assembly 16 may be configured in a variety of designs to provide adequate magnetic strength for adhering to a ferromagnetic surface. In one exemplary embodiment, magnet assembly 16 includes a plurality of bar magnets held in a nonferromagnetic frame. The magnets may be tapered to fit within corresponding slots in the frame or may be secured in any other conventional manner. Magnet assembly 16 is rotatably attached to frame 14 by, e.g., a rotating axle 22.

Frame 14 may include a handle 24 and, in a preferred embodiment, includes sharpened dowel 26. As explained in the '155 patent, incorporated herein by reference, dowel 26 acts to resist movement of magnet assembly 16 along ferromagnetic surface 12 and increases the amount of the load that can be supported by gripper assembly 10 to resist gravitational force. Frame 14 is preferably constructed of stainless steel in order to provide a corrosion resistant material for use in a variety of applications and to provide wear resistance for cam surfaces 20, discussed below, for extra overall strength and endurance for the surfaces that engage and move against ferromagnetic surface 12.

In accordance with the present invention, magnet shell 18 is provided to engage magnet assembly 16. Magnet shell 18 is particularly discussed with respect to FIG. 3, but ears 28 extend therefrom along ferromagnetic surface 12. Ears 28 are a particular feature of this invention and can be provided in a number of embodiments, e.g., extending directly from magnet assembly 16, but a preferred form of the invention provides ears 28 extending from shell 18.

Frame 14 defines cam surfaces 20 symmetrically located about magnet assembly 16. As frame 20 is rotated, cam surfaces 20 act to raise or lower rotatable mounting 22 with respect to ferromagnetic surface 12. The cam surfaces are preferably identical to prevent rotation of magnet assembly 28 ferromagnetic surface 12. It will be appreciated that the magnetic attraction between magnet assembly 16 and surface 12 may be hundreds of pounds, which the present invention seeks to overcome by various lever arms that arise in the course of rotating frame 14. A first lever arm arises from the radius of curvature of cam surfaces 20 and the action of the cams against surface 12. In accordance with the present invention, ears 28 provide a pivot point displaced from magnet assembly 16. As frame 14 is rotated, the resulting lever lifts magnet assembly 16 from surface 12 and creates an air gap that decreases the magnetic force that holds magnetic assembly 16 to surface 12. To form yet another lever arm, lifting bar 32 is fixed at connector 34 to magnet assembly 16. As frame 14 is rotated, frame 14 contacts lifting bar 32 to provide an additional force to rotate magnet assembly 16 about ear 28 to create an air gap.

Figure 2:
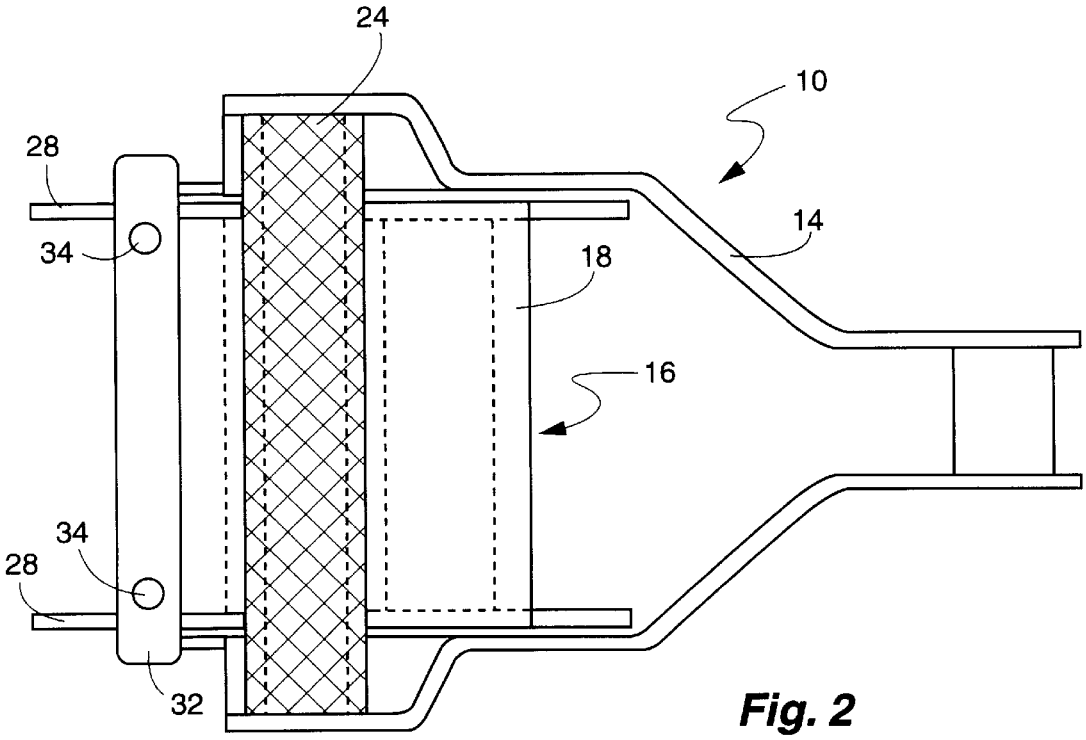
FIG. 2 is a pictorial illustration in top view of the device shown in FIG. 1.
Figure 5A:
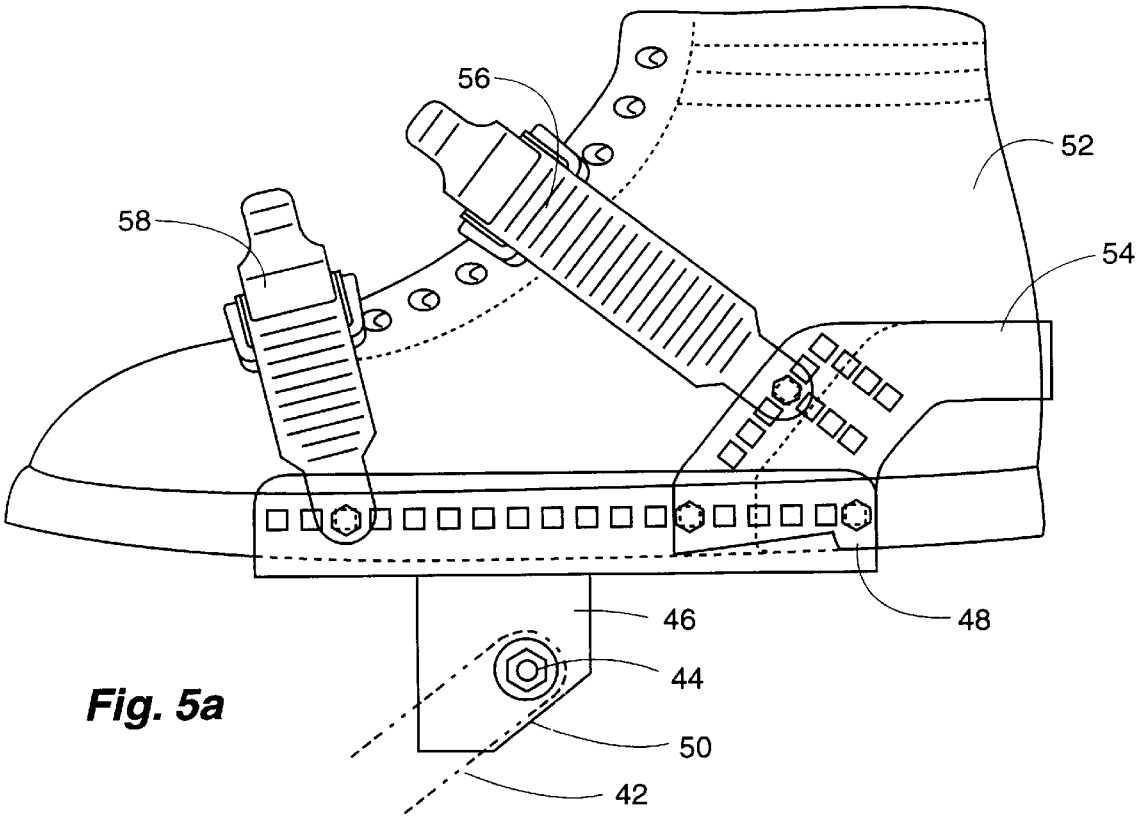
FIGS. 5A and 5B are pictorial illustration of a shoe platform for use with the device shown in FIG. 1.
Figure 5B:
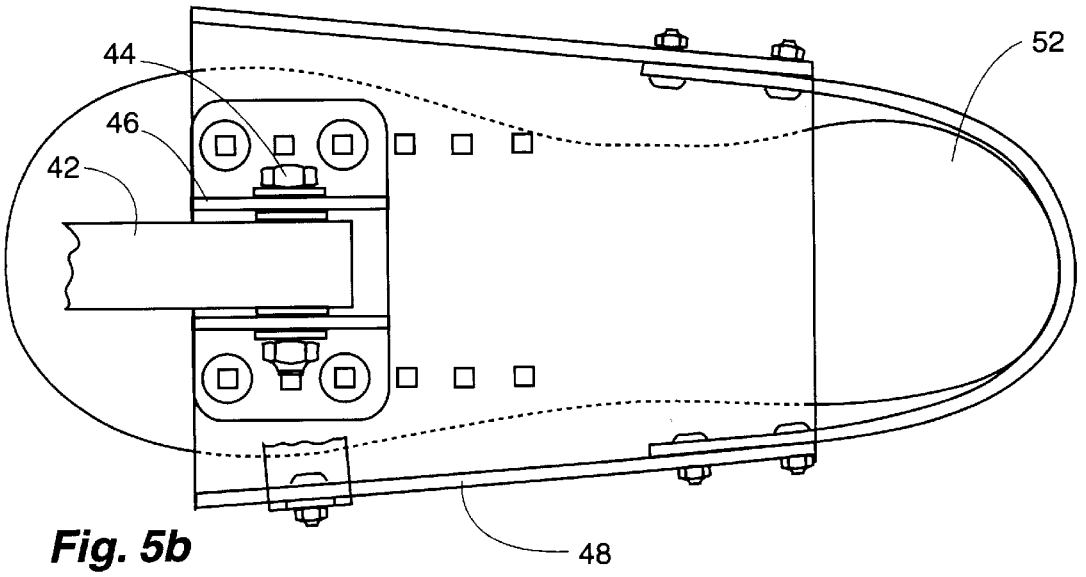

FIG. 2 is a top view of the magnetic gripper device 10 shown in FIG. 1. Frame 14 is shown with diverging arms to hold handle 24, but a solid arm could be provided with a handle therethrough, as shown in FIGS. 5A and 5B. Magnet shell 18 encloses magnet assembly 16, and defines ears 28 extending therefrom. Bar 32 is fixed at connector 34 to magnet assembly 16 and has a length effective to engage frame 14 as frame 14 is rotated about cam surfaces 20 (FIG. 1).

Figure 3:
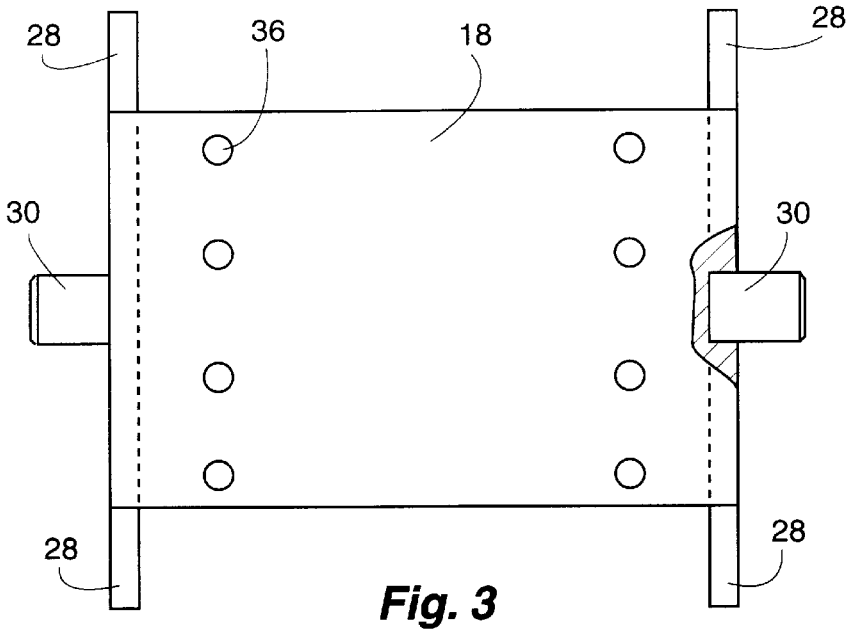
FIG. 3 is a top view of a magnet shell according to one embodiment of the present invention.

FIG. 3 more particularly depicts magnet shell 18. Magnet shell 18 has sides depending therefrom that define ears 28. In one embodiment, ears 28 extend in both directions from shield 18 so that the direction of installation is not a factor, but ears 28 need to extend in only one direction to engage ferromagnetic surface 12 (FIG. 1). The depending sides of shield 18 preferably cover the sides of magnet assembly 16 to prevent individual bar magnets from sliding out of magnet assembly 16 (FIGS. 1 and 2). In one embodiment, shell 18 is secured to magnet assembly 16 with bolts, or the like, through mounting holes 36 and further includes pins 30 that form axles for rotatable mounting within frame 14 (FIG. 1).

Figure 4:
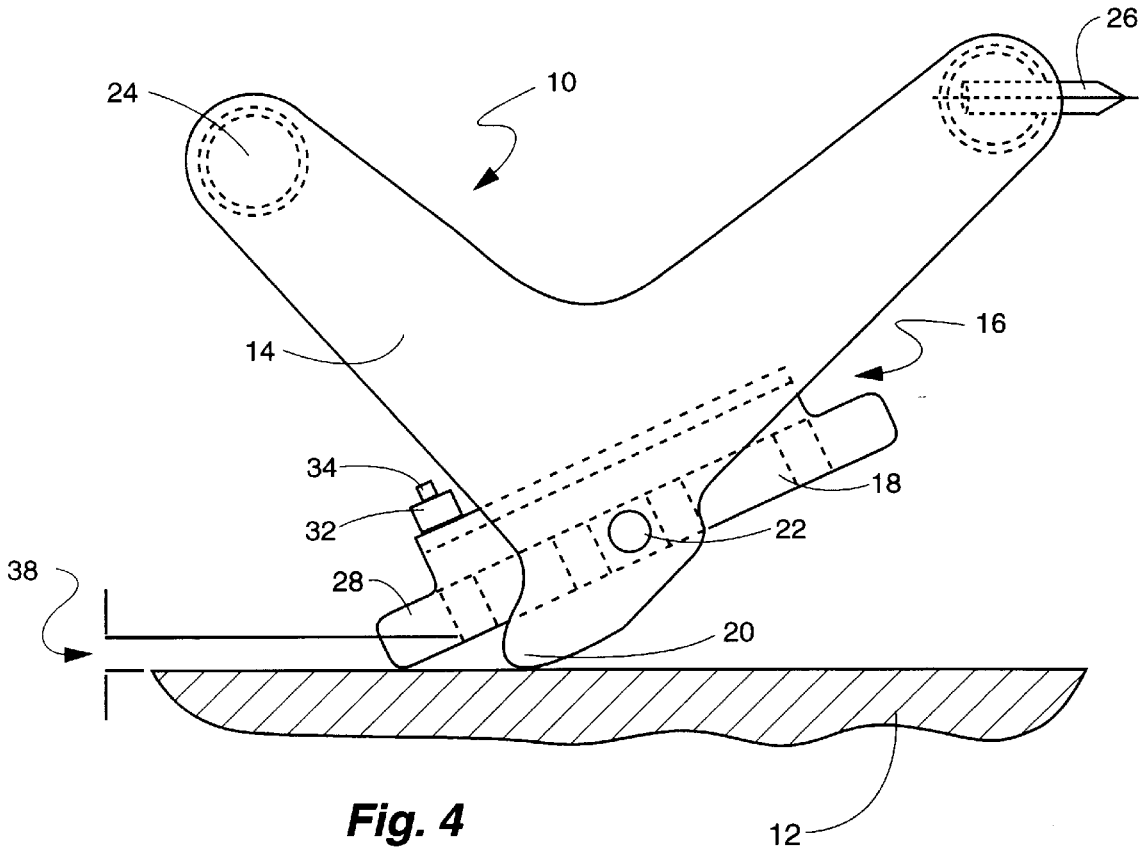
FIG. 4 is a pictorial illustration of the device shown in FIG. 1 rotated to move the magnet relative to the ferromagnetic surface.

FIG. 4 more particularly depicts the interaction of the components of gripper assembly 10 when magnet assembly 16 is moved adjacent ferromagnetic surface 12. Frame 14 is rotated on cam surfaces 20 to raise or lower rotatable connector 22 above surface 12. As rotatable connector 22 rises, magnet assembly 16 begins to pivot about the tip of ears 28 so that the forward bar magnet is raised from surface 12 to create air gap 38. The presence of air gap 38 acts to control the force between magnet assembly 16 and ferromagnetic surface 12 so that gripper assembly 10 is controllably lowered onto or raised from surface 12. When frame 14 is rotated through a selected angle, e.g., 45°, frame 14 contacts bar 32 to further assist in engaging ear 28 onto surface 12 and to rotate the remainder of magnet assembly 16 above surface 12.

The construction of the magnetic gripper described above with reference to FIGS. 1–3 is directed primarily to a hand hold where the user can readily rotate the frame to engage and disengage the gripper from a ferromagnetic surface. In some instances, it is desired to form a foot hold so that the user can perform repairs and maintenance on the structure formed by the ferromagnetic surface. FIGS. 5A and 5B depict an embodiment of magnetic gripper for supporting the feet of a user. The basic gripper assembly is as described for FIGS. 1–3, but a foot support is attached to frame 42. Foot plate 48 is rotatably mounted to frame 42 through connector plate 46. As shown in FIGS. 5A and 5B, frame 42 is formed as a single piece to accommodate pivot connection 44.

Shoe plate 48 can readily pivot forward about pivot connection 44, but connector plate 46 includes lip 50, which engages frame 42 to limit backward movement of support plate 48. Thus, a user can rotate the foot forward to engage and disengage the gripper from the surface and can then have the necessary support against backward rotation of support plate 48.

As shown in FIG. 5A, the foot support preferably includes straps 56, 58 to engage a shoe 52 and secure shoe 52 to support plate 48. Heel plate 54 may be provided to better secure shoe 52. There are numerous adjustable strap designs that are commercially available and that may be used to securely engage a shoe 52 to foot support 48.

It is contemplated that the gripper described above may be fabricated from a variety of high strength materials. Steels and high strength aluminum may be used for some applications, but these materials are heavy. If the grippers must be physically handled for periods of time, it may be preferable to use high strength plastics or composite materials, such as graphite impregnated with epoxy. While the cams will generally be made of a wear resistant metal, the cams may be formed with wear resistant inserts cast into a plastic or composite material.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for releasable attachment to a ferromagnetic surface, comprising:

a magnet for adhering to said ferromagnetic surface;

a frame pivotably attached to said magnet, said frame defining cam surfaces to raise and lower said magnet from said ferromagnetic surface;

an ear extending from and rigidly affixed to magnet said to engage said ferromagnetic surface at a location spaced from said cam surfaces so as to pivot an end of said magnet away from said ferromagnetic surface at said location.

2. Apparatus according to claim 1, further including a bar mounted on said magnet to engage said frame as said frame is rotated on said cam surfaces to pivot said magnet about said ear.

3. Apparatus according to claim 1, further including a shell attached to said magnet, said shell defining said ear and having side members effective to retain bar magnet components in said magnet.

4. Apparatus according to claim 2, further including a bar mounted on said magnet to engage said frame as said frame is rotated on said cam surfaces to pivot said magnet about said ear.

5. Apparatus according to claim 1, further including a pin attached to said frame for mechanically engaging said ferromagnetic surface when said magnet is adhered to said ferromagnetic surface.

6. Apparatus according to claim 1, further including a plate rotatably attached to said frame for engaging and supporting a foot of a user of said apparatus.

* * * * *